US009980077B2

(12) United States Patent
Lee et al.

(10) Patent No.: US 9,980,077 B2
(45) Date of Patent: May 22, 2018

(54) METHOD OF INTERPOLATING HRTF AND AUDIO OUTPUT APPARATUS USING SAME

(71) Applicant: LG ELECTRONICS INC., Seoul (KR)

(72) Inventors: Tung Chin Lee, Seoul (KR); Jongyeul Suh, Seoul (KR); Ling Li, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days. days.

(21) Appl. No.: 15/674,045

(22) Filed: Aug. 10, 2017

(65) Prior Publication Data

US 2018/0048979 A1 Feb. 15, 2018

Related U.S. Application Data

(60) Provisional application No. 62/373,366, filed on Aug. 11, 2016.

(51) Int. Cl.

| | |
|---|---|
| ***H04R 5/00*** | (2006.01) |
| ***H04S 7/00*** | (2006.01) |
| ***H04S 3/00*** | (2006.01) |

(52) U.S. Cl.

CPC ..... *H04S 7/303* (2013.01); *H04S 3/008* (2013.01); *H04S 7/305* (2013.01); (Continued)

(58) Field of Classification Search

CPC .... H04R 3/00; H04R 5/00; H04R 5/04; H04S 2400/01; H04S 2400/03; H04S 2400/11; (Continued)

(56) References Cited

U.S. PATENT DOCUMENTS 8,422,690 B2 * 4/2013 Matsuura ..... H04S 1/002 381/1
9,226,090 B1 * 12/2015 Norris ..... H04R 5/04
(Continued)

FOREIGN PATENT DOCUMENTS

KR 10-2014-0027954 A 3/2014
WO WO 2015/134658 A1 9/2015

*Primary Examiner* — Thang Tran
(74) *Attorney, Agent, or Firm* — Birch, Stewart, Kolasch & Birch, LLP

(57) ABSTRACT

A method of interpolating a head-related transfer function (HRTF) and an audio output apparatus using the same are disclosed. The method includes receiving HRTF data corresponding to a point at which an altitude angle and an azimuth angle cross and receiving complementary information about a point at which the HRTF data is present, generating an HRTF interpolation signal corresponding to an altitude angle of a sound localization point, using HRTF data corresponding to two points constituting an altitude angle segment nearest the sound location point, calculating an amount of variation up to an azimuth angle θ of the sound localization point, using complementary information of two points constituting an azimuth angle segment nearest the sound localization point, and generating a final HRTF interpolation signal corresponding to the sound localization point by applying the amount of variation to the HRTF interpolation signal corresponding to the altitude angle of the sound localization point.

20 Claims, 6 Drawing Sheets

(52) U.S. Cl.
CPC ..... *H04S 2400/01* (2013.01); *H04S 2400/03* (2013.01); *H04S 2420/01* (2013.01)

(58) Field of Classification Search
CPC ..... H04S 2420/01; H04S 7/305; H04S 7/303; H04S 7/302; G06F 3/012; G10L 19/008
See application file for complete search history.

(56) References Cited

U.S. PATENT DOCUMENTS

| | | | | |
|---|---|---|---|---|
| 9,800,990 | B1 * | 10/2017 | Lyren | H04S 3/008 |
| 2006/0177078 | A1 * | 8/2006 | Chanda | H04S 1/005 381/309 |
| 2010/0080396 | A1 * | 4/2010 | Aoyagi | H04S 1/005 381/17 |
| 2010/0322428 | A1 * | 12/2010 | Fukui | H04S 7/30 381/17 |
| 2011/0286601 | A1 * | 11/2011 | Fukui | H04S 7/30 381/17 |
| 2011/0305358 | A1 * | 12/2011 | Nishio | H04S 7/305 381/303 |
| 2014/0328505 | A1 * | 11/2014 | Heinemann | H04S 7/303 381/303 |
| 2015/0156599 | A1 * | 6/2015 | Romigh | H04S 5/005 381/17 |
| 2015/0319550 | A1 * | 11/2015 | Fujita | H04S 7/30 381/303 |
| 2016/0119731 | A1 * | 4/2016 | Lester, III | H04R 29/001 381/59 |
| 2017/0164085 | A1 * | 6/2017 | Romigh | H04S 1/002 |

* cited by examiner

METHOD OF INTERPOLATING HRTF AND AUDIO OUTPUT APPARATUS USING SAME

CROSS-REFERENCE TO RELATED APPLICATION

This application claims the benefit of U.S. provisional application 62/373,366, field on Aug. 11, 2016, which is hereby incorporated by reference as if fully set forth herein.

BACKGROUND OF THE INVENTION

Field of the Invention

The present invention relates to a method of interpolating a head-related transfer function (HRTF) and an audio output apparatus using the same.

Discussion of the Related Art

Recently, with advances in information technology (IT), a variety of smart devices has been developed. Particularly, smart devices basically provide audio output having various effects. An HRTF has been widely used for efficient audio output. The HRTF is summarized as a function of a frequency response which is measured according to direction after generating the same sound in all directions. It is desirable that the HRTF be differently determined according to characteristics of the head or body of each person. Recently, an individualized HRTF has been developed in the laboratory. According to a conventionally used HRTF scheme, generalized HRTF data is stored in a database and is identically applied to all users during audio output.

If a user desires to localize a sound source in an arbitrary space, convolution of an original sound is performed with respect to an HRTF measured at a corresponding point. However, since the HRTF measured at a specific point is generally discontinuous, an interpolation method is used when it is desired to localize a sound image at a point at which the HRTF is not measured or to localize a moving sound image. A typical HRTF interpolation method includes a method of calculating a weighted sum of a plurality of HRTFs (HRTFs of 3 or 4 points) measured at the nearest points based on a point at which it is desired to localize the sound image. Generally, near points are selected as points indicating the smallest value when the distances between a point at which it is desired to localize the sound image and points having measured information are calculated using a method such as a Euclidean distance.

However, application of the above conventional HRTF interpolation method to a sound image having a fast motion in a real-time environment is difficult. Therefore, an interpolation method of a small number of calculations applicable to the real-time environment is needed.

SUMMARY OF THE INVENTION

Accordingly, the present invention is directed to a method of interpolating an HRTF and an audio output apparatus using the same that substantially obviate one or more problems due to limitations and disadvantages of the related art.

An object of the present invention is to provide an HRTF interpolation method used during real-time audio output.

Another object of the present invention is to provide an audio output apparatus for providing audio output using a new HRTF interpolation method.

Another object of the present invention is to provide an audio output system for providing audio output using a new HRTF interpolation method.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of interpolating a head-related transfer function (HRTF) used for audio output includes receiving HRTF data corresponding to a point at which an altitude angle and an azimuth angle cross and receiving complementary information about a point at which the HRTF data is present, generating an HRTF interpolation signal corresponding to an altitude angle $\Phi$ of a sound localization point $(\theta, \Phi)$, using HRTF data corresponding to two points constituting an altitude angle segment nearest the sound location point $(\theta, \Phi)$, calculating an amount of variation up to an azimuth angle $\theta$ of the sound localization point $(\theta, \Phi)$, using complementary information of two points constituting an azimuth angle segment nearest the sound localization point $(\theta, \Phi)$, and generating a final HRTF interpolation signal corresponding to the sound localization point $(\theta, \Phi)$ by applying the amount of variation to the HRTF interpolation signal corresponding to the altitude angle $\Phi$ of the sound localization point.

The HRTF data corresponding to the point at which the altitude angle and the azimuth angle cross may be provided through an HRTF database (DB).

The complementary information may be interaural level difference (ILD) data. The ILD data may be provided through an ILD DB.

The calculating may include calculating an ILD weighted sum from ILD data corresponding to azimuth angles of two points and calculating the amount of variation of an ILD up to the azimuth angle $\theta$ of the sound location point $(\theta, \Phi)$, using the calculated ILD weighted sum.

The generating the HRTF interpolation signal may include generating a left-channel HRTF interpolation signal and a right-channel HRTF interpolation signal corresponding to the altitude angle $\Phi$ of the sound localization point $(\theta, \Phi)$, using an HRTF weighted sum of two points of the altitude angle.

The generating the final HRTF interpolation signal may include generating the final HRTF interpolation signal by applying the amount of variation of the ILD to the left-channel HRTF interpolation signal and the right-channel HRTF interpolation signal corresponding to the altitude angle $\Phi$ of the sound localization point $(\theta, \Phi)$.

In another aspect of the present invention, an audio output apparatus includes an audio decoder configured to decode an input audio bitstream and output the decoded audio signal and a renderer configured to generate an audio signal corresponding to a sound localization point $(\theta, \Phi)$ for the decoded audio signal, wherein the renderer performs an HRTF interpolation process of generating a head-related transfer function (HRTF) interpolation signal corresponding to an altitude angle $\Phi$ of the sound localization point $(\theta, \Phi)$, using HRTF data corresponding to two points constituting an altitude angle segment nearest the sound location point $(\theta, \Phi)$, calculating an amount of variation up to an azimuth angle θ of the sound localization point (θ, Φ), using complementary information of two points constituting an azimuth angle segment nearest the sound localization point (θ, Φ), and generating a final HRTF interpolation signal corresponding to the sound localization point (θ, Φ) by applying the amount of variation to an HRTF interpolation signal for an altitude angle Φ of the sound localization point (θ, Φ).

The audio output apparatus may further include an HRTF database (DB) including HRTF data corresponding to the point at which the altitude angle and the azimuth angle cross.

The audio output apparatus may further include an interaural level difference (ILD) DB including ILD data as the complementary information.

The renderer may further include a filter configured to filter and output the decoded audio signal using the final HRTF interpolation signal.

The audio output apparatus may further include a filer configured to change the audio signal output through the renderer to a specific file format.

The audio output apparatus may further include a downmixer configured to change a multichannel signal to a stereo-channel signal when the decoded audio signal is the multichannel signal.

The calculating the amount of variation in the HRTF interpolation process may include calculating an interaural level difference (ILD) weighted sum from ILD data corresponding to azimuth angles of two points and calculating an amount of variation of an ILD up to the azimuth angle θ of the sound location point (θ, Φ), using the calculated ILD weighted sum.

The generating the HRTF interpolation signal in the HRTF interpolation process may include generating a left-channel HRTF interpolation signal and a right-channel HRTF corresponding to the altitude angle Φ of the sound localization point (θ, Φ), using an HRTF weighted sum of two points of the altitude angle.

The generating the final HRTF interpolation signal in the HRTF interpolation process may include generating the final HRTF interpolation signal by applying the amount of variation of the ILD to the left-channel HRTF interpolation signal and the right-channel HRTF interpolation signal corresponding to the altitude angle Φ of the sound localization point (θ, Φ).

In another aspect of the present invention, a method of interpolating a head-related transfer function (HRTF) used for audio output includes an azimuth angle segment nearest to a sound localization point (θ, Φ) instead of an altitude angle segment, calculating a weighted sum of HRTF data of two points constituting the azimuth angle segment, and calculating an amount of variation of an interaural level difference (ILD) using an altitude angle segment nearest to the sound localization point (θ, Φ) and ILD data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
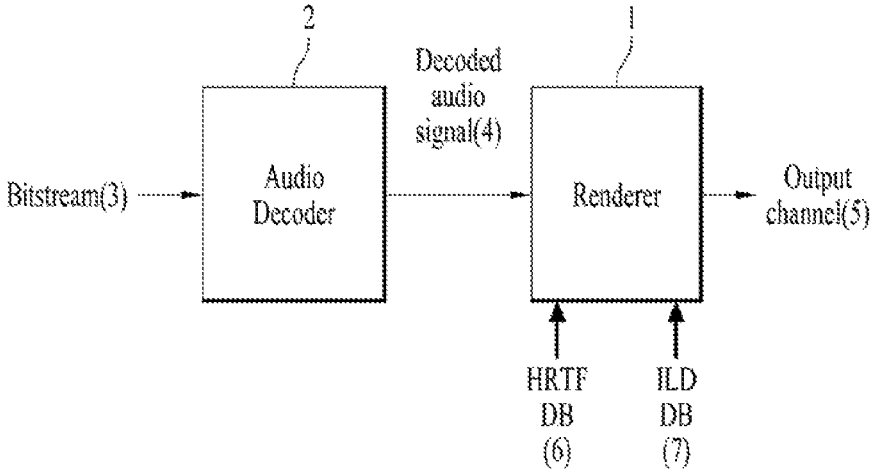
FIG. 1 illustrates an audio decoder and a renderer according to an embodiment of the present invention.

Reference will now be made in detail to the embodiments of the present invention, examples of which are illustrated in the accompanying drawings. In the drawings, the same or similar elements are denoted by the same reference numerals even though they are depicted in different drawings, and a detailed description of the same or similar elements will be omitted. The suffixes "module" and "unit" used in the description below are given or used together only in consideration of ease in preparation of the specification and do not have distinctive meanings or functions. In addition, in the following description of the embodiments disclosed herein, a detailed description of related known technologies will be omitted when it may make the subject matter of the embodiments disclosed herein rather unclear. In addition, the accompanying drawings have been made only for a better understanding of the embodiments disclosed herein and are not intended to limit technical ideas disclosed herein, and it should be understood that the accompanying drawings are intended to encompass all modifications, equivalents and substitutions within the sprit and scope of the present invention.

FIG. 1 illustrates an audio decoder 2 and a renderer 1 according to an embodiment of the present invention. In particular, the renderer 1 to which an HRTF interpolation method of the present invention is applied receives HRTF data and complementary information. The complementary information is, for example, inter-aural level difference (ILD) data. However, the complementary information of the present invention may be information other than the ILD data. For example, an inter-aural time difference (ITD) information may be used as the complementary information The renderer 1 receives HRTF data and ILD data from an HRTF database (DB) 6 and an ILD DB 7, respectively. Notably, the present invention is not limited to reception of the HRTF data and the ILD data from a specific DB. That is, the HRTF data and the ILD data may be received through various input schemes. For example, a user may directly input the data through a user interface and the HRTF data and the ILD data downloaded via an external network may be used.

If a bitstream acquired by encoding an audio signal is input to the audio decoder 2, the audio decoder 2 decodes the audio signal using a decoding scheme suitable for an input audio bitstream format. The decoding schemes of the audio decoder 2 are not limited to a specific audio decoding format and may use any of currently widely known various audio decoding schemes. The audio signal decoded through the audio decoder 2 is input to the renderer 1 and is output as a desired audio output signal 5. This will now be described in detail.

Figure 2A:
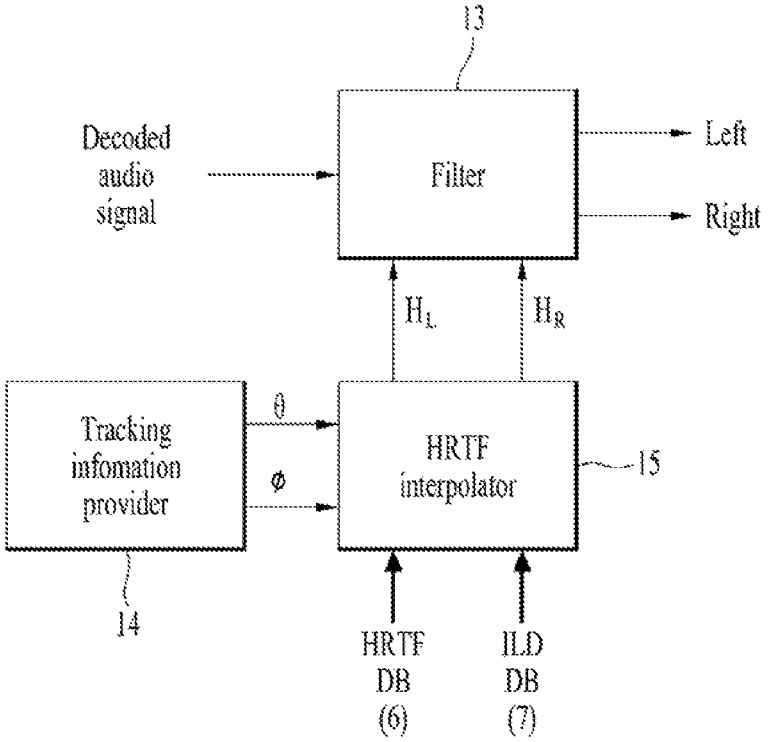
FIGS. 2*a* and 2*b* illustrate detailed configurations of the audio renderer according to embodiments of the present invention.
Figure 2B:
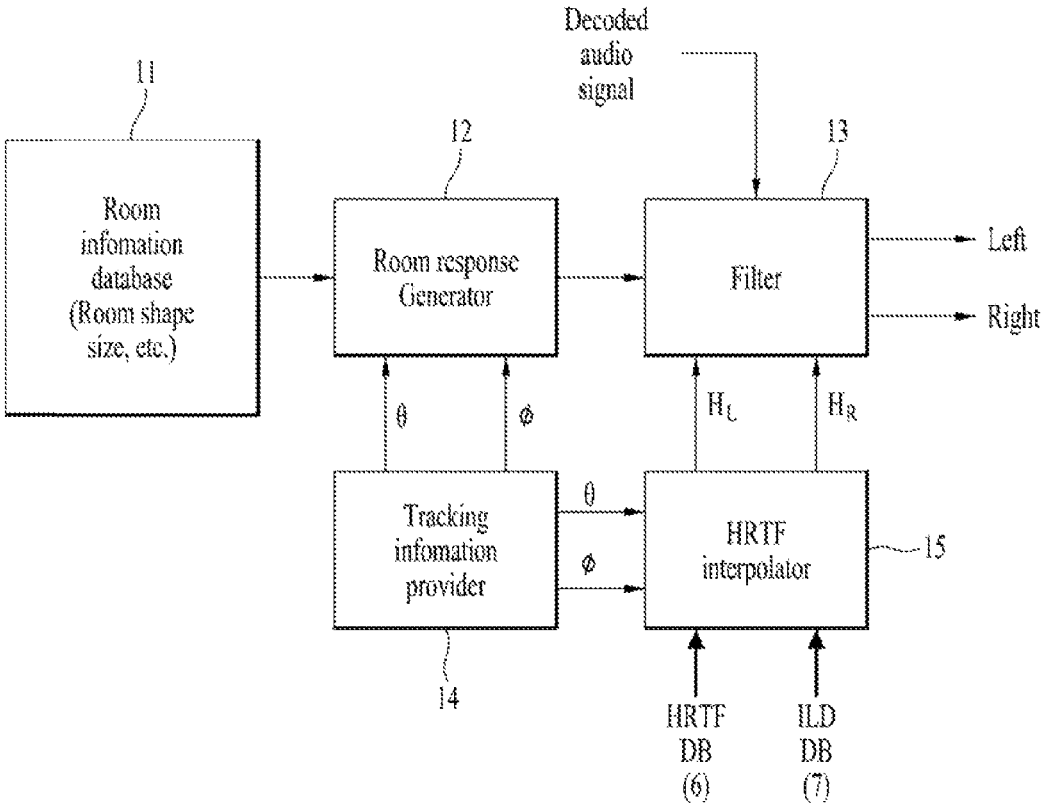

FIGS. 2*a* and 2*b* illustrate detailed configurations of the audio renderer 1 of the present invention. FIG. 2*a* illustrates an embodiment of the audio renderer 1. Referring to FIG. 2*a*, the audio renderer 1 includes an HRTF interpolator 15 and a tracking information provider 14. The audio renderer 1 further includes a filter 13 for receiving the audio signal decoded by the audio decoder 2 and left-channel and right-channel HRTF data HL and HR interpolated through the HRTF interpolator 15 and outputs left-channel and right-channel audio signals.

The tracking information provider 14 provides the sound localization point (θ, Φ) about a sound image that is desired to be currently output to the HRTF interpolator 15. The tracking information provider 14 may be a head tracker for tracking user movement or a user may directly provide the related information through a user interface. For example, the sound localization point (θ, Φ) provided by the tracking information provider 14 is information representing an azimuth angle θ and an altitude angle Φ.

The HRTF interpolator 15 receives the sound localization point (θ, Φ). If HRTF data corresponding to the received sound localization point is present in the HRTF DB 6, the HRTF interpolator 15 may use the HRTF data and, if HRTF corresponding to the received sound localization point is not present in the HRTF DB 6, the HRTF interpolator 15 may perform the HRTF interpolation method of the present invention with reference to the ILD DB 7. Next, the HRTF interpolator 15 generates the interpolated HRTF which is then output to the filter 13.

FIG. 2*b* illustrates another embodiment of the audio renderer 1. Referring to FIG. 2*b*, the audio renderer 1 further uses information about a room in which the user is located. That is, a room information DB 11 stores information about a type of a room in which the user is located (e.g., a rectangular room type, a circular room type, or a partially open room type) and the size of the room. A room response generator 12 receives related information from the room information DB 11 and the tracking information provider 14 and transmits a room response to the filter 13. Therefore, as compared with the embodiment of FIG. 2*a*, the embodiment of FIG. 2*b* can efficiently reflect characteristics of the room in which the user is located. Hereinafter, a detailed configuration and an interpolation method of the HRTF interpolator 15 illustrated in FIGS. 2*a* and 2*b* will be described.

Figure 3:
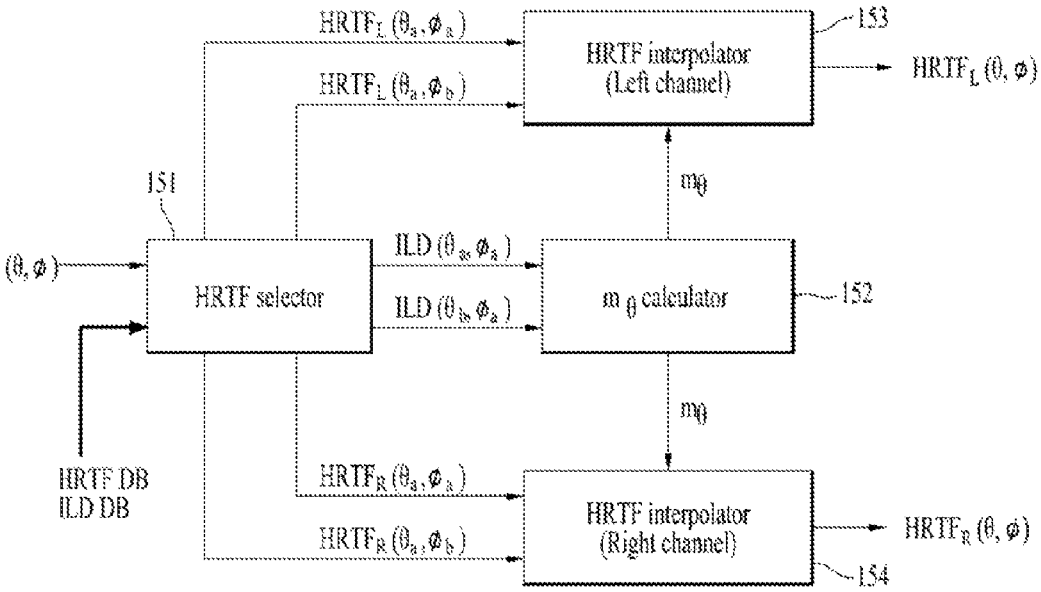
FIG. 3 illustrates a detailed configuration and an operation process of an HRTF interpolator 15 according to an embodiment of the present invention.

FIG. 3 illustrates a detailed configuration and an operation process of the HRTF interpolator 15 according to an embodiment of the present invention. The HRTF interpolator 15 include an HRTF selector 151, an ILD variation calculator (or $m_\theta$ calculator) 152, a left-channel HRTF interpolator 153, and a right-channel HRTF interpolator 154.

The HRTF selector 151 receives the sound localization point (θ, Φ) from the tracking information provider 14, detects the nearest altitude angle segment based on an altitude angle, and extracts HRTF data of two points constituting the detected segment. For example, in FIG. 4, if a segment 151*b* is detected as an altitude angle segment nearest arbitrary sound localization point x (151*a*, (θ, Φ)) two points constituting the segment 151*b* are determined to be $A(\theta_{\Phi A}, \Phi_{\Theta A})$ and $B(\theta_{\Phi A}, \Phi_{\Theta B})$. In addition, the HRTF selector 151 receives the sound localization point x (151*a*, (θ, Φ)), detects the nearest azimuth angle segment based on an azimuth angle, and extracts ILD data of two points constituting the detected segment. For example, in FIG. 4, if a segment 151*c* is detected as an azimuth angle segment nearest the sound localization point x (151*a*, (θ, Φ)) two points constituting the segment 151*c* are determined to be $A(\theta_{\Phi A}, \Phi_{\Theta A})$ and $C(\theta_{\Theta B}, \Phi_{\Theta A})$. The HRTF selector 151 provides HRTF data and ILD data selected through the above process to the left-channel and right-channel HRTF interpolators 153 and 154 and the ILD variation calculator 152, respectively.

The ILD variation calculator 152 calculates the amount $m_\theta$ of variation of an ILD generated when a user moves from an azimuth angle $\theta_{\Phi A}$ of a point A to an azimuth angle θ of the sound localization point x among azimuth angles for two extracted points (e.g., a segment A-C 151*c* in FIG. 4), using the ILD data provided from the HRTF selector 151. The calculated ILD variation $m_\theta$ is provided to the left-channel HRTF interpolator 153 and a right-channel HRTF interpolator 154.

More specifically, a process of selecting the nearest altitude angle and azimuth angle segments by the HRTF selector 151 may be indicated by equations as follows.

If the sound localization point (θ, Φ) about the sound image is input to the HRTF selector 151, the HRTF selector 151 searches for segments nearest the altitude angle Φ and the azimuth angle θ. Generally, an HRTF is measured at a point at which the segment of the azimuth angle and the segment of the altitude angle cross and is stored in the HRTF DB 6 together with the sound localization point. For example, an altitude angle segment A-B and an azimuth angle segment A-C nearest the sound localization point x (151*a*, (θ, Φ)) in FIG. 4 may be calculated by Equation 1.

$$\Theta m = \underset{m}{\operatorname{argmin}}(|\phi - \phi_m|),\ m = 1, \ldots, M \qquad \text{[Equation 1]}$$

$$\Phi n = \underset{n}{\operatorname{argmin}}(|\theta - \theta_n|),\ n = 1, \ldots, N$$

where N and M denote the numbers of times measured at an arbitrary azimuth angle and altitude angle, respectively, and Θm and Φn denote indexes of segments of an azimuth angle and an altitude angle, respectively. If adjacent segments at the altitude angle and the azimuth angle are detected and a point at which the two segments cross is generated. If this point is assumed to be $(\theta_{\Phi A}, \Phi_{\Theta A})$, HRTF data and ILD data measured nearest the sound location point information (θ, Φ)) may be extracted using Equation (2).

$$X = \operatorname{sign}(\theta - \theta_{\Phi A})$$

$$Y = \operatorname{sign}(\varphi - \varphi_{\Theta A}) \qquad \text{[Equation 2]}$$

where X and Y denote only −1 or 1. Therefore, a total of 4 cases may be generated according to combination. For example, referring to FIG. 4, since X is 1 and Y is 1 $(\theta_{\Theta B} > \theta_{\Phi A}, \Phi_{\Theta B} > \Phi_{\Theta A})$, HRTF data of points $A(\theta_{\Phi A}, \Phi_{\Theta A})$, and $B(\theta_{\Phi A}, \Phi_{\Theta B})$ and ILD data of points $A(\theta_{\Phi A}, \Phi_{\Theta A})$ and $C(\theta_{\Phi B}, \Phi_{\Theta A})$ are extracted. That is, left-channel HRTF data $HRTF_L(\theta_{\Phi A}, \Phi_{\Theta A})$ and $HRTF_L(\theta_{\Phi A}, \Phi_{\Theta B})$ and right-channel HRTF data $HRTF_R(\theta_{\Phi A}, \Phi_{\Theta A})$ and $HRTF_R(\theta_{\Phi A}, \Phi_{\Theta B})$, corresponding to location information $A(\theta_{\Phi A}, \Phi_{\Theta A})$ and $B(\theta_{\Phi A}, \Phi_{\Theta B})$, are extracted from an HRTF DB 6. In addition ILD information ($ILD(\theta_{\Phi A}, \Phi_{\Theta A})$, $ILD(\theta_{\Phi B}, \Phi_{\Theta A})$) corresponding to location information $A(\theta_{\Phi A}, \Phi_{\Theta A})$ and $C(\theta_{\Phi B}, \Phi_{\Theta A})$ is extracted from the ILD DB 7.

However, if X is 1 and Y is −1, the HRTF selector 151 extracts HRTF data of points $A(\theta_{\Phi A}, \Phi_{\Theta A})$ and $B(\theta_{\Phi A}, \Phi_{\Theta B})$ and ILD data of points $B(\theta_{\Phi A}, \Phi_{\Theta B})$ and $D(\theta_{\Phi B}, \Phi_{\Theta B})$.

Figure 5:
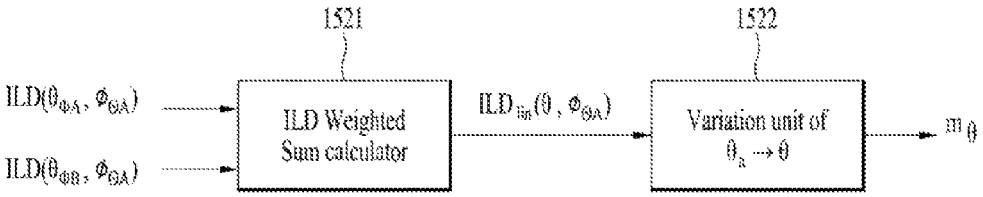
FIG. 5 illustrates a detailed configuration and a calculation process of an ILD variation calculator and an ILD variation calculation process according to an embodiment of the present invention.

FIG. 5 illustrates a detailed configuration of the ILD variation calculator 152 and an ILD variation calculation process according to an embodiment of the present invention. Generally, the unit of ILD data stored in the ILD DB 7 is decibels (dB) and is calculated by Equation 3. Therefore, an ILD value of the unit of dB may be converted into a linear value using Equation 4.

$$ILD(\theta, \phi) = 10\log_{10}\frac{\lambda_L^2(\theta, \phi)}{\lambda_R^2(\theta, \phi)} \quad \text{[Equation 3]}$$

$$ILD_{lin}(\theta, \phi) = 10^{ILD(\theta,\phi)/10} \quad \text{[Equation 4]}$$

In Equation 3, $\lambda^2_{ch}(\theta, \Phi)$ (where ch=L or R) represents the power of an HRTF calculated at an arbitrary location (θ, Φ). ILD data $ILD(\theta, \Phi_{\Theta A})$ corresponding to an azimuth angle θ is calculated, by an ILD weighted sum calculator 1521, as a weighted sum of input ILD data $ILD_{lin}(\theta_{\Phi A}, \Phi_{\Theta A})$ and $ILD_{lin}(\theta_{\Phi B}, \Phi_{\Theta A})$ converted into linear values as indicated by Equation (5).

$$ILD_{lin}(\theta, \phi_{\Theta A}) = (1 - g_\theta)ILD_{lin}(\theta_{\Phi A}, \phi_{\Theta A}) + g_\theta ILD_{lin}(\theta_{\Phi B}, \phi_{\Theta A}), \quad \text{where } g_\theta = \frac{\theta \bmod D_\theta}{D_\theta} \quad \text{[Equation 5]}$$

The weighted sum according to Equation 5 is calculated by a variation calculator 1522 and the amount $m_\theta$ of variation of the ILD from the azimuth angle $\theta_{\Phi A}$ to the sound localization point azimuth angle θ is calculated using Equation 6. The calculated amount $m_\theta$ of variation of the ILD is provided to the left-channel HRTF interpolator 153 and the right-channel HRTF interpolator 154.

$$m_\theta = \frac{ILD_{lin}(\theta, \phi_{\Phi A}) - ILD_{lin}(\theta_{\Phi A}, \phi_{\Phi A})}{ILD_{lin}(\theta_{\Phi B}, \phi_{\Phi A}) - ILD_{lin}(\theta_{\Phi A}, \phi_{\Phi A})} \quad \text{[Equation 6]}$$

Figure 6:
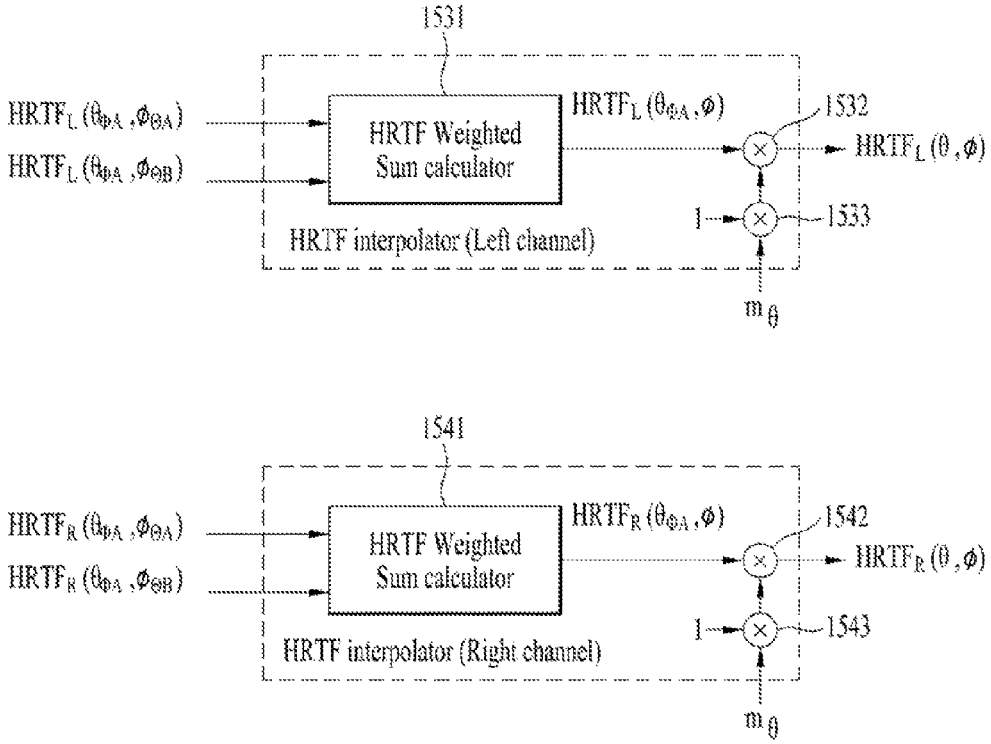
FIG. 6 illustrates detailed configurations of left-channel and right-channel HRTF interpolators according to an embodiment of the present invention.

FIG. 6 illustrates detailed configurations of the left-channel and right-channel HRTF interpolators 153 and 154 and finally interpolated HRTF output processes according to an embodiment of the present invention. As described above, the left-channel HRTF data $HRTF_L(\theta_{\Phi A}, \Phi_{\Theta A})$ and $HRTF_L(\theta_{\Phi A}, \Phi_{\Theta B})$ and the right-channel HRTF data $HRTF_R(\theta_{\Phi A}, \Phi_{\Theta A})$ and $HRTF_R(\theta_{\Phi A}, \Phi_{\Theta B})$, extracted by the HRTF selector 151, are input to the left-channel HRTF interpolator 153 and the right-channel HRTF interpolator 154, respectively. In addition, the amount $m_\theta$ of variation of the ILD calculated by the ILD variation calculator 152 is input to the left-channel HRTF interpolator 153 and the right-channel HRTF interpolator 154.

The left-channel and right-channel HRTF interpolators 153 and 154 respectively include HRTF weighted sum calculators 1531 and 1541, subtractors 1533 and 1543, and operators 1532 and 1542. For example, the HRTF weighted sum calculators 1531 and 1541 calculate a weighted sum $HRTF_{ch}(\theta_{\Phi A}, \Phi)$ (where ch=L or R) of an HRTF for two input points with respect to HRTF data corresponding to an altitude angle through Equation 7.

$$HRTF_{ch}(\theta_{\Phi A}, \phi) = (1 - g_\phi)HRTF_{ch}(\theta_{\Phi A}, \phi_{\Theta A}) + g_\phi HRTF_{ch}(\theta_{\Phi A}, \phi_{\Theta B}), \quad \text{where } g_\phi = \frac{\phi \bmod D_\phi}{D_\phi},\ ch = L, R \quad \text{[Equation 7]}$$

If an HRTF calculated by Equation 7 is applied to a sound source, an effect is recognized as though a sound image were located at the altitude.

Next, the subtractors 1533 and 1543 and the operators 1532 and 1542 output finally interpolated HRTF data $HRTF_L(\theta, \Phi)$ and $HRTF_R(\theta, \Phi)$ by applying the input amount $m_\theta$ of variation of the ILD to the weighted sum data $HRTF_{ch}(\theta_{\Phi A}, \Phi)$ (where ch=L or R) per channel. Generally, since humans characteristically recognize the direction of a located sound image corresponding to the size of a sound source input to both ears, if the amount $m_\theta$ of variation of the ILD is applied to $HRTF_{ch}(\theta_{\Phi A}, \Phi)$, the location of the sound image moves in proportion to the amount of variation. Specifically, if the amount of variation which is generated while the sound image is changed from $\theta_{\Phi A}$ to θ is calculated using the ILD variation $m_\theta$ and the amount of variation is applied to the left-channel and right-channel HRTF data $HRTF_L(\theta_{\Phi A}, \Phi)$ and $HRTF_R(\theta_{\Phi A}, \Phi)$, the sound image is recognized as though it were located at an arbitrary azimuth angle θ.

Figure 4:
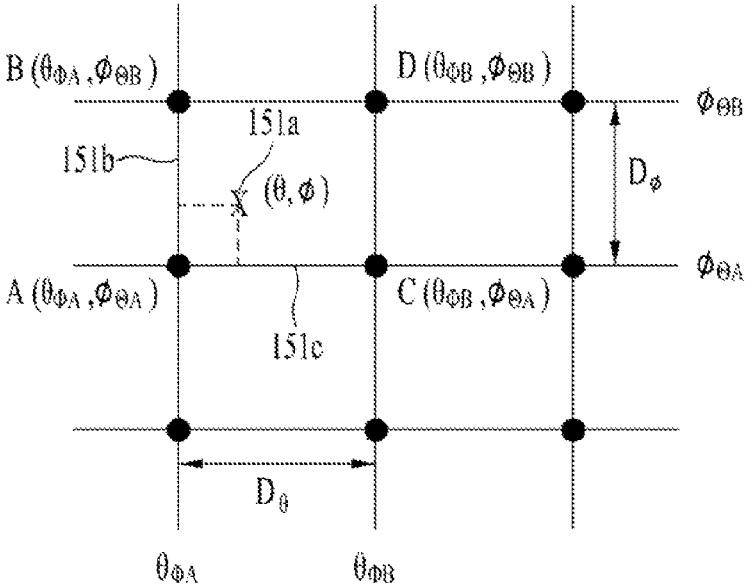
FIG. 4 illustrates an exemplary location of a sound image in space, referred to for explaining an embodiment of the present invention.

The above-described HRTF interpolation process detects an altitude angle segment (e.g., 151*b* (A-B) in FIG. 4) nearest a sound source localization point (θ, Φ), calculates ah HRTF data weighted sum of two points A and B constituting the altitude angle segment, and then uses ILD data as an azimuth angle segment (e.g., 151*c* in FIG. 4). The above embodiment is characterized in that the amount $m_\theta$ of variation of the ILD is extracted by Equation 6. Another embodiment of the present invention will now be described.

Another embodiment of the present invention provides an azimuth angle (or altitude angle) interpolation method using the ILD data rather than the amount of variation of the ILD. That is, the power value of the sound location point (θ, Φ) is calculated using the ILD data, which will be described later, (without extracting the amount $m_\theta$ of variation of the ILD) instead of Equation 6 and the power value is used for HRTF interpolation. Specifically, in Equation 3 and Equation 4, $\lambda^2_{ch}(\theta, \Phi)$ (where ch=L or R) represents the power of an HRTF calculated at the sound location point (θ, Φ). In addition, since the condition of "$\lambda^2_L(\theta, \Phi)+\lambda^2_R(\theta, \Phi)=1$" is satisfied, if Equation 3 and Equation 4 are simultaneously calculated, the power value ($(\lambda_L(\theta, \Phi), \lambda_R(\theta, \Phi))$ of the sound location point (θ, Φ) is calculated by Equation 8.

$$\lambda_L(\theta, \phi) = \sqrt{\frac{1}{1 + 10^{ILD(\theta,\phi)/10}}}, \quad \lambda_R(\theta, \phi) = \sqrt{\frac{10^{ILD(\theta,\phi)/10}}{1 + 10^{ILD(\theta,\phi)/10}}} \quad \text{[Equation 8]}$$

Therefore, the left-channel HRTF $HRTF_L(\theta, \Phi)$ and the right-channel HRTF $HRTF_R(\theta, \Phi)$ at the sound location point $(\theta, \Phi)$ may be calculated using the power value $(\lambda_L(\theta, \Phi), \lambda_R(\theta, \Phi))$ of the sound location point $(\theta, \Phi)$ as indicated by Equation 9.

$$HRTF_L(\theta, \phi) = \frac{\lambda_L(\theta, \phi_{\theta A})}{\lambda_L(\theta_{\phi A}, \phi_{\theta A})} HRTF_L(\theta_{\phi A}, \phi) \quad \text{[Equation 9]}$$

$$HRTF_R(\theta, \phi) = \frac{\lambda_R(\theta, \phi_{\theta A})}{\lambda_R(\theta_{\phi A}, \phi_{\theta A})} HRTF_R(\theta_{\phi A}, \phi)$$

$HRTF_L(\theta_{\Phi A}, \Phi)$ and $HRTF_R(\theta_{\Phi A}, \Phi)$ applied to Equation 9 may be calculated as a weighted sum of two HRTFs measured at the nearest altitude angle segment from the sound localization point $(\theta, \Phi)$ as in Equation 7. In addition, $\lambda_L(\theta_{\Phi A}, \Phi_{\Theta A})$ and $\lambda_R(\theta_{\Phi A}, \Phi_{\Theta A})$ applied to Equation 9 may be calculated by applying ILD data corresponding to the point $A(\theta_{\Phi A}, \Phi_{\Theta A})$ in FIG. 4 to Equation 8. In addition, $\lambda_L(\theta, \Phi_{\Theta A})$ and $\lambda_R(\theta, \Phi_{\Theta A})$ applied to Equation 9 may be calculated by applying $ILD_{lin}(\theta, \Phi_{\Theta A})$ calculated through Equation 5 to Equation 4 and Equation 8.

As a further embodiment of the present invention, the azimuth angle segment (e.g., 151*c* (A-C) in FIG. 4) nearest the sound localization point $(\theta, \Phi)$ is firstly detected, a weighted sum of HRTF data of two points A and C constituting the azimuth angle segment is calculated, and the altitude angle segment (e.g., the segment 151*b* in FIG. 4) may use the ILD data.

Figure 7:
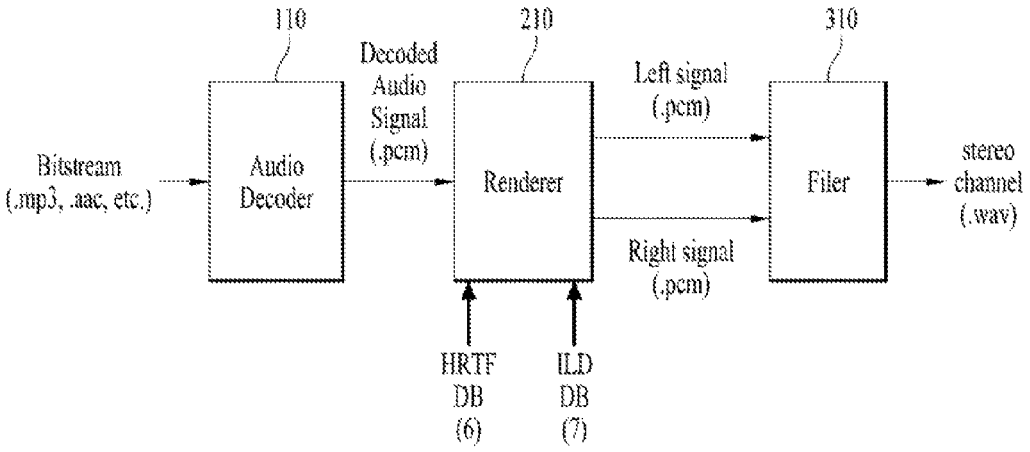
FIG. 7 illustrates an audio output apparatus for a mono-channel audio signal according to an embodiment of the present invention.
Figure 8:
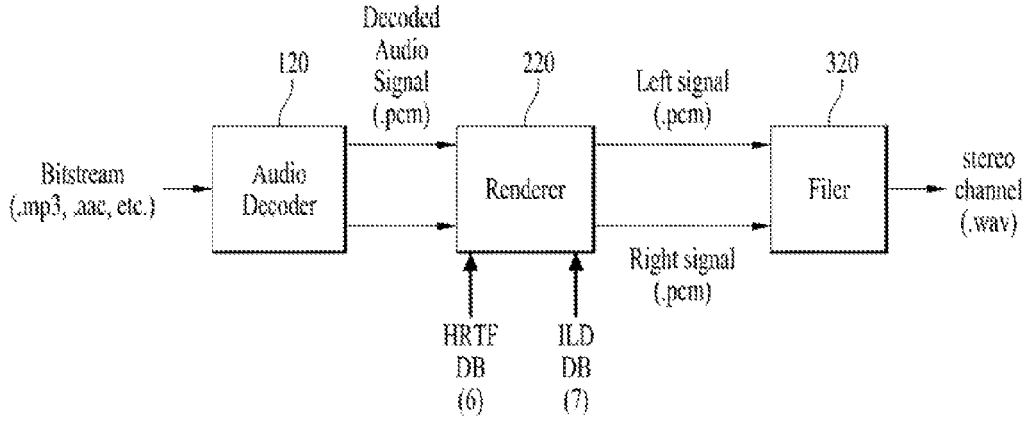
FIG. 8 illustrates an audio output apparatus for a stereo-channel audio signal according to an embodiment of the present invention.
Figure 9:
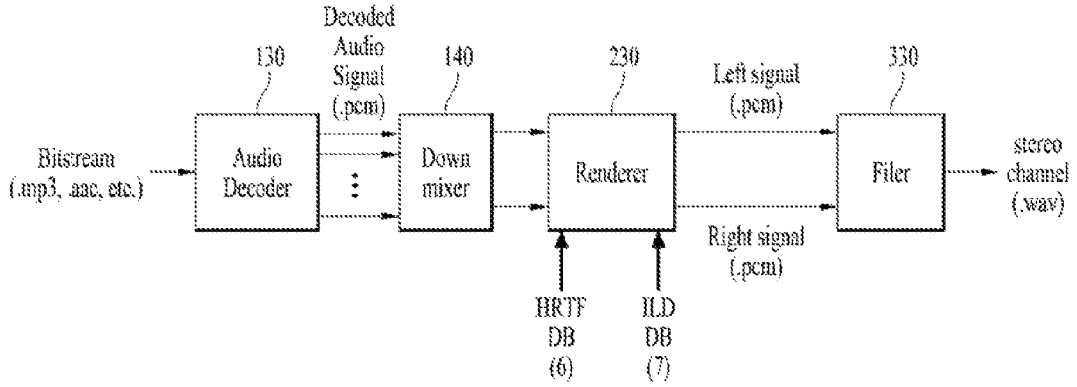
FIG. 9 illustrates an audio output apparatus for a multi-channel audio signal according to an embodiment of the present invention.

FIGS. 7 to 9 illustrate audio output apparatuses for a mono-channel audio signal, a stereo-channel audio signal, and a multi-channel audio signal, respectively, according to an embodiment of the present invention.

A bitstream applied to an audio decoder is transmitted by an encoder in the form of an audio compression file format of a specific mono-channel (e.g., .mp3 or .aac). An audio signal restored by the audio decoder 110 may be PCM data (.pcm) used generally in a wave file format but the present invention is not limited thereto. The PCM data is input to a renderer 210 of FIG. 7. The renderer 210 performs real-time HRTF interpolation using the HRTF DB 6 and the ILD DB 7 with respect to the input PCM data as described earlier and outputs left-channel PCM data (left signal (.pcm)) and right-channel PCM data (right signal (.pcm)). The left-channel PCM data (left signal (.pcm)) and the right-channel PCM data (right signal (.pcm)) are output as a final stereo wave file (.wav) through a filer 310. Herein, the output of the stereo wave file (.wav) through the filer 310 is optional and may be differently applied according to use environment.

In addition, as illustrated in FIG. 8, if a signal restored from an audio decoder 120 is a stereo-channel signal (or PCM data), the corresponding restored signal is input to a renderer 220. The renderer 220 generates output signals by applying interpolated left-channel and right-channel HRTFs to a left signal and a right signal of the stereo signal, respectively. The output signals are generated as a final stereo wave file (.wav) through a filer 320. Herein, the output of the stereo wave file (.wav) through the filer 320 is optional and may be differently applied according to a use environment.

In FIG. 9, if a signal restored from an audio decoder 130 is a multi-channel signal (or PCM data), the restored multichannel signal is down-mixed to a stereo-channel signal through a down-mixer 140 and then input to a renderer 230. The renderer 230 generates output signals by applying interpolated left-channel and right-channel HRTFs to a left signal and a right signal of the stereo signal, respectively. The output signals are generated as a final stereo wave file (.wav) through a filer 330. Herein, the output of the stereo wave file (.wav) through the filer 330 is optional and may be differently applied according to use environment.

The HRTF interpolation method and apparatus according to the embodiments of the present invention have the following effects.

First, an interpolated HRTF value can be used for real-time audio output. Accordingly, natural audio immersion for a moving sound image on a real-time basis in content such as virtual reality, films, and gaming can be provided.

Second, the interpolated HRTF value can be used for audio output with a fast motion. An interpolation method having a small number of calculations is demanded with respect to audio output having a fast motion (e.g., virtual reality or gaming) on a real-time basis. The HRTF interpolation method of the present invention can reduce the number of calculations by about 5 to 10 times according to a used frequency bin.

The present invention may be implemented as computer-readable code that can be written on a computer-readable medium in which a program is recorded. The computer-readable medium may be any type of recording device in which data that can be read by a computer system is stored. Examples of the computer-readable medium include a hard disk drive (HDD), a solid state drive (SSD), a silicon disk drive (SDD), a read only memory (ROM), a random access memory (RAM), a compact disc (CD)-ROM, a magnetic tape, a floppy disk, an optical data storage, and a carrier wave (e.g., data transmission over the Internet). The computer may include an audio decoder and a renderer. It will be apparent to those skilled in the art that various modifications and variations can be made in the present invention without departing from the spirit or scope of the inventions. Thus, the present invention is intended to cover the modifications and variations of this invention provided they come within the scope of the appended claims and their equivalents.

What is claimed is:

1. A method of interpolating a head-related transfer function (HRTF) used for audio output, comprising:

receiving HRTF data corresponding to a point at which an altitude angle and an azimuth angle cross and receiving complementary information about a point at which the HRTF data is present;

generating an HRTF interpolation signal corresponding to an altitude angle $\Phi$ of a sound localization point $(\theta, \Phi)$, using HRTF data corresponding to two points constituting an altitude angle segment nearest the sound location point $(\theta, \Phi)$;

calculating an amount of variation up to an azimuth angle $\theta$ of the sound localization point $(\theta, \Phi)$, using complementary information of two points constituting an azimuth angle segment nearest the sound localization point $(\theta, \Phi)$; and generating a final HRTF interpolation signal corresponding to the sound localization point $(\theta, \Phi)$ by applying the amount of variation to the HRTF interpolation signal corresponding to the altitude angle $\Phi$ of the sound localization point.

2. The method according to claim 1, wherein the HRTF data corresponding to the point at which the altitude angle and the azimuth angle cross is provided through an HRTF database (DB).

3. The method according to claim 2, wherein the complementary information is interaural level difference (ILD) data.

4. The method according to claim 3, wherein the ILD data is provided through an ILD DB.

5. The method according to claim 4, wherein the calculating includes calculating an ILD weighted sum from ILD data corresponding to the two points constituting an azimuth angle segment nearest the sound localization point (θ, Φ) and calculating the amount of variation of an ILD up to the azimuth angle θ of the sound location point (θ, Φ), using the calculated ILD weighted sum.

6. The method according to claim 5, wherein the generating the HRTF interpolation signal includes generating a left-channel HRTF interpolation signal and a right-channel HRTF interpolation signal corresponding to the altitude angle Φ of the sound localization point (θ, Φ), using an HRTF weighted sum of two points of the altitude angle.

7. The method according to claim 6, wherein the generating the final HRTF interpolation signal includes generating the final HRTF interpolation signal by applying the amount of variation of the ILD to the left-channel HRTF interpolation signal and the right-channel HRTF interpolation signal corresponding to the altitude angle Φ of the sound localization point (θ, Φ).

8. An audio output apparatus, comprising:

an audio decoder configured to decode an input audio bitstream and output the decoded audio signal; and a renderer configured to generate an audio signal corresponding to a sound localization point (θ, Φ) for the decoded audio signal, wherein the renderer performs an HRTF interpolation process of generating a head-related transfer function (HRTF) interpolation signal corresponding to an altitude angle Φ of the sound localization point (θ, Φ), using HRTF data corresponding to two points constituting an altitude angle segment nearest the sound location point (θ, Φ), calculating an amount of variation up to an azimuth angle θ of the sound localization point (θ, Φ), using complementary information of two points constituting an azimuth angle segment nearest the sound localization point (θ, Φ), and generating a final HRTF interpolation signal corresponding to the sound localization point (θ, Φ) by applying the amount of variation to an HRTF interpolation signal for an altitude angle ilk of the sound localization point (θ, Φ).

9. The audio output apparatus according to claim 8, further comprising an HRTF database (DB) including HRTF data corresponding to the point at which the altitude angle and the azimuth angle cross.

10. The audio output apparatus according to claim 9, further comprising an interaural level difference (ILD) DB including ILD data as the complementary information.

11. The audio output apparatus according to claim 8, wherein the renderer further includes a filter configured to filter and output the decoded audio signal using the final HRTF interpolation signal.

12. The audio output apparatus according to claim 8, further comprising a filer configured to change the audio signal output through the renderer to a specific file format.

13. The audio output apparatus according to claim 8, further comprising a down-mixer configured to change a multichannel signal to a stereo-channel signal when the decoded audio signal is the multichannel signal.

14. The audio output apparatus according to claim 10, wherein the calculating the amount of variation in the HRTF interpolation process includes calculating an interaural level difference (ILD) weighted sum from ILD data corresponding to azimuth angles of two points and calculating an amount of variation of an ILD up to the azimuth angle θ of the sound location point (θ, Φ), using the calculated ILD weighted sum.

15. The audio output apparatus according to claim 14, wherein the generating the HRTF interpolation signal in the HRTF interpolation process includes generating a left-channel HRTF interpolation signal and a right-channel HRTF corresponding to the altitude angle Φ of the sound localization point (θ, Φ), using an HRTF weighted sum of two points of the altitude angle.

16. The audio output apparatus according to claim 15, wherein the generating the final HRTF interpolation signal in the HRTF interpolation process includes generating the final HRTF interpolation signal by applying the amount of variation of the ILD to the left-channel HRTF interpolation signal and the right-channel HRTF interpolation signal corresponding to the altitude angle Φ of the sound localization point (θ, Φ).

17. A method of interpolating a head-related transfer function (HRTF) used for audio output, comprising:

receiving HRTF data corresponding to a point at which an altitude angle and an azimuth angle cross and receiving complementary information about a point at which the HRTF data is present;

generating an HRTF interpolation signal corresponding to an azimuth angle θ of a sound localization point (θ, Φ), using HRTF data corresponding to two points constituting an azimuth angle segment nearest the sound location point (θ, Φ);

calculating an amount of variation up to an altitude angle Φ of the sound localization point (θ, Φ), using from complementary information of two points constituting an altitude angle segment nearest the sound localization point (θ, Φ): and generating a final HRTF interpolation signal corresponding to the sound localization point (θ, Φ) by applying the amount of variation to the HRTF interpolation signal corresponding to the azimuth angle θ of the sound localization point.

18. The method according to claim 17, wherein the HRTF data corresponding to the point at which the altitude angle and the azimuth angle cross is provided through an HRTF database (DB).

19. The method according to claim 18, wherein the complementary information is interaural level difference (ILD) data.

20. The method according to claim 19, wherein the ILD data is provided through an ILD DB.

* * * * *